United States Patent [19]

Sumiyoshi et al.

[11] 4,232,517

[45] Nov. 11, 1980

[54] EXHAUST GAS CONTROL ACTUATOR

[75] Inventors: Masaharu Sumiyoshi; Katsuhiko Motosugi, both of Toyota, Japan

[73] Assignee: Toyota Jidosha Kogyo Kabushiki Kaisha, Toyota, Japan

[21] Appl. No.: 940,445

[22] Filed: Sep. 7, 1978

[30] Foreign Application Priority Data

Mar. 13, 1978 [JP] Japan ..... 53-29096

[51] Int. Cl.[3] ..... F01N 3/10

[52] U.S. Cl. ..... 60/276; 60/289; 60/290; 137/625.62; 251/30

[58] Field of Search ..... 60/276, 289, 290; 137/625.62; 251/30

[56] References Cited

U.S. PATENT DOCUMENTS

| | | | |
|---|---|---|---|
| 3,473,548 | 10/1969 | Erickson | 137/625.62 |
| 3,724,808 | 4/1973 | Sugden | 251/30 |
| 3,880,186 | 4/1975 | Turner | 251/30 |
| 3,961,608 | 6/1976 | Hertfelder | 251/30 |
| 4,149,376 | 4/1979 | Masaki | 60/290 |

*Primary Examiner*—Douglas Hart
*Attorney, Agent, or Firm*—Cushman, Darby & Cushman

[57] ABSTRACT

An exhaust gas control actuator wherein the feed of secondary air fed to an exhaust piping is controlled by an oxygen concentration detector disposed in the stream of exhaust gas of an internal combustion engine and an air-fuel ratio of the exhaust gas entering a catalyst disposed downstream of the exhaust piping is maintained within a given range. The actuator comprises a flow control valve and a flow control device for controlling the flow control valve. The flow control valve is provided with a flow-in port communicated with an air pump and the valve body, a flow-out port communicated with an exhaust manifold and a bypass port communicated with an air cleaner. Furthermore, the flow control device is actuated by an electronic control circuit and comprises an actuating chamber partitioned by a diaphragm for actuating the valve body and including a negative pressure introducing port communicated with an intake manifold and an atmosphere introducing port constantly communicated with atmosphere, and a nozzle flapper mechanism provided in the actuating chamber and varying resistances to flow through the negative pressure introducing port and the atmosphere introducing port in accordance with the actuating position of the valve body in such a manner that an output signal of the oxygen concentration detector in negatively fed back to the feed of secondary air.

8 Claims, 8 Drawing Figures

EXHAUST GAS CONTROL ACTUATOR

BACKGROUND OF THE INVENTION

1. Field of Invention

The present invention relates to an exhaust gas control actuator suitable for feed-back controlling the feed of secondary air fed to an exhaust piping by detecting the concentration of exhaust gas from an engine.

2. Prior Art

In general, it has been known that, in order to simultaneously decrease HC, CO and $NO_x$ in the gas exhausted from an engine, the air-fuel ratio of the exhaust gas flowing into a catalytic device, particularly, a three-way catalytic converter, should be maintained within a narrow range centered around the theoretical or stoichiometrical air-fuel ratio. Consequently, an air-fuel ratio of a carbureter of an engine is set on the side richer than the theoretical air-fuel ratio, a supply of secondary air is blown into an exhaust manifold of an exhaust piping from an air pump, led to a three-way catalytic converter via an exhaust pipe disposed downstream, and a feed-back is made to control the feed of secondary air so that an air-fuel ratio of an exhaust gas entering the three-way catalytic converter can be maintained within a narrow range centered around the theoretical air-fuel ratio by a signal from an exygen concentration detector (hereinafter referred to as an "$O_2$ sensor") provided at an inlet of the three-way catalytic converter, thereby enabling to simultaneously decrease HC, CO and $NO_x$ in the exhaust gas and increase the power performance of the vehicle.

However, with the conventional system for supplying secondary air to an exhaust piping, such problems are presented that it is difficult to secure the durability of the catalyst due to the influence of the output characteristics of an $O_2$ sensor as will be described below.

Namely, although an exhaust gas in the exhaust pipe whose apparent air-fuel ratio is equalized to the theoretical air-fuel ratio by being fed with secondary air and an exhaust gas produced from theoretical air-fuel mixture when a mixture having the theoretical air-fuel ratio is burned in an engine have the air-fuel ratio identical with each other, they differ in composition from each other. The former is higher in values of $H_2$, CO and $O_2$ than the latter. Furthermore, an $O_2$ sensor utilizing zirconia ($ZrO_2$) is affected not only by the concentration of $O_2$ but also concentrations of $H_2$, CO, particularly, $H_2$, and the air-fuel ratio at which the output voltage has sharply risen is shifted to the side leaner than the theoretical air-fuel ratio. Therefore, the $O_2$ sensor shows such an output characteristics that the signal change point of the $O_2$ sensor disposed in an exhaust piping fed with secondary air is shifted to the side leaner than the theoretical air-fuel ratio.

Additionally, a catalyst has $O_2$ storage action to a certain extent, and hence, even if the air-fuel ratio of the exhaust gas varies by about $\pm 0.5$ with respect to the theoretical air-fuel ratio, HC, CO and $NO_x$ can be simultaneously purified at a high purification rate as in the case of the exhaust gas having the theoretical air-fuel ratio. However, when the concentrations of $H_2$, CO and HC are high in the composition of the exhaust gas, the average working temperature of the catalyst becomes higher, which, therefore, leads to a problem of the overheat of the catalyst under a high load operation for a long period of time, thus requiring consideration for protecting a pellet carrying the catalyst, a container and the like against overheating.

Further, the three-way catalytic converter is durable in the use conditions such as always subjected to a reducing environment (the rich exhaust gas) or an oxidizing environment (the lean exhaust gas) alternately and the deterioration of the purification performance thereof is low. However, if the rate at which the three-way catalytic converter is subjected to the oxidizing environment is high, then the durability thereof decreases, the deterioration of the purification performance thereof is sped up, and, in general, the durability decreases to scores of thousands kilometers calculated in terms of the running distance. As described above, the fact that the signal change point of the $O_2$ sensor is shifted to the side leaner than the theoretical air-fuel ratio increases the rate at which the three-way catalytic converter is subjected to the oxidizing environment which, further, makes the securing of the durability of the catalyst more difficult in cooperation with the fact that, owing to the heat generation by the oxidation, the working temperature of the catalyst becomes higher than the case where the exhaust gas is treated under the true theoretical air-fuel ratio.

Additionally, the speed of response to the $O_2$ sensor installed in the exhaust piping, in the case the air-fuel ratio becomes higher than the theoretical air-fuel ratio and a rich signal of the fuel shifts to a lean signal of the fuel, shows a moderately falling characteristics as indicated by a characteristic curve A in FIG. 1 wherein the time T is given as an abscissa and the output voltage V of the $O_2$ sensor is given as an ordinate, and in the case contrary to the above, shows a sharply rising characteristics as indicated by a characteristic curve B in FIG. 1. Namely, with regard to the time lag characteristics of the $O_2$ sensor, the time lag is different in magnitude depending upon the direction of the change-over of the output signal. In order to precisely control the air-fuel ratio of the exhaust gas entering the catalyst as centered around the theoretical air-fuel ratio, it is desirable to set a controlling amplitude centered around the theoretical air-fuel ratio within a smallest possible range on the plus and minus sides.

Furthermore, in the secondary air control system as above, the following requirement has been made from the aspect of the operation of the engine. Namely, in order to meet the demand in the output without increasing the volume of the engine as compared with the size of the vehicle, render the vehicle light in weight and improve the fuel consumption, it is desirable to make the air-fuel ratio of the carbureter rich up to about 12.5–11.5 for example at the time of the acceleration or the high output condition of the vehicle. Additionally, when an air pump whose delivery is directly proportional to RPM of the engine is used in respect of the secondary air supply, it is desirable that the feed rate of secondary air can be controlled in accordance with the change in air intake amount of the engine even under the constant RPM of the engine, and further, that the feed of secondary air is as quickly as possible and appropriately controlled through feedback to purify the exhaust gas under the various conditions of the engine such as the cold starting with insufficient warming up. Further, it is also desirable that the supply of secondary air is interrupted for the protection of the catalyst when the catalyst is overheated due to the operation under high load for a long period of time, and, that the supply of secondary air is performed at its maximum degrees when there is a possibility of the catalyst overheat at the engine braking after the high speed running, thereby simply effecting the protection of the catalyst.

SUMMARY OF THE INVENTION

Accordingly, it is the general object of the present invention to provide an exhaust gas control actuator for feeding secondary air to the rich exhaust gas exhausted from the engine, wherein the feed of secondary air can be corrected within a wide range from the maximum to the minimum in accordance with the requirements of the engine in output, and the amplitude for controlling the feed rate of secondary air at the normal and constant operation of the engine is maintained within a narrow range to thereby improve the accuracy in control. Additionally, another object of the present invention is to provide an exhaust gas control actuator wherein the feed of secondary air is controlled in serrate or triangular wave forms in relation to the time, the overshoot of the air-fuel ratio of the exhaust gas from the theoretical air-fuel ratio due to the time lag differing depending upon the direction of the change-over of the output signal from the $O_2$ sensor is restrained within a given range, the lean shift of the output characteristics of the $O_2$ sensor is compensated, the catalyst is prevented from being overheated, and the durability of the catalyst can be secured. A further object of the present invention is to provide an exhaust gas control actuator wherein such a load responsiveness exists that the feed of secondary air quickly varies in accordance with the change of the engine in air intake quantity.

In keeping with the principles of the present invention, the objects are accomplished by a unique exhaust gas control actuator wherein an $O_2$ sensor disposed in the stream of exhaust gas of an internal combustion engine is adapted to control the feed rate of secondary air and the air-fuel ratio of the exhaust gas flowing into the catalyst disposed downstream of the exhaust piping is maintained in a given range, said exhaust gas control actuator comprising a flow control valve and a flow control device for controlling the flow control valve. The flow control valve is provided with a valve body, a flow-in port communicated with an air pump, a flow-out port communicated with an exhaust manifold and a bypass port communicated with an air cleaner. The flow control device is provided with: an actuating chamber which is partitioned by a diaphragm for actuating the valve body and including a vacuum introducing port communicated with an intake manifold by an output signal from the $O_2$ sensor via an electronic control circuit and an atmosphere introducing port constantly communicated with atmosphere; and a nozzle flapper mechanism incorporated in the actuating chamber for varying flow resistances at the vacuum introducing port and at the atmosphere introducing port in accordance with the actuating position of the valve body so that an output signal from the $O_2$ sensor is negatively fed back to the feed of secondary air.

BRIEF DESCRIPTION OF THE DRAWINGS

The above-mentioned features and objects of the present invention will become more apparent with reference to the following description, taken in conjunction with the accompanying drawings, wherein like-referenced numerals denote like elements, and in which.

DETAILED DESCRIPTION OF THE INVENTION

Figure 2:
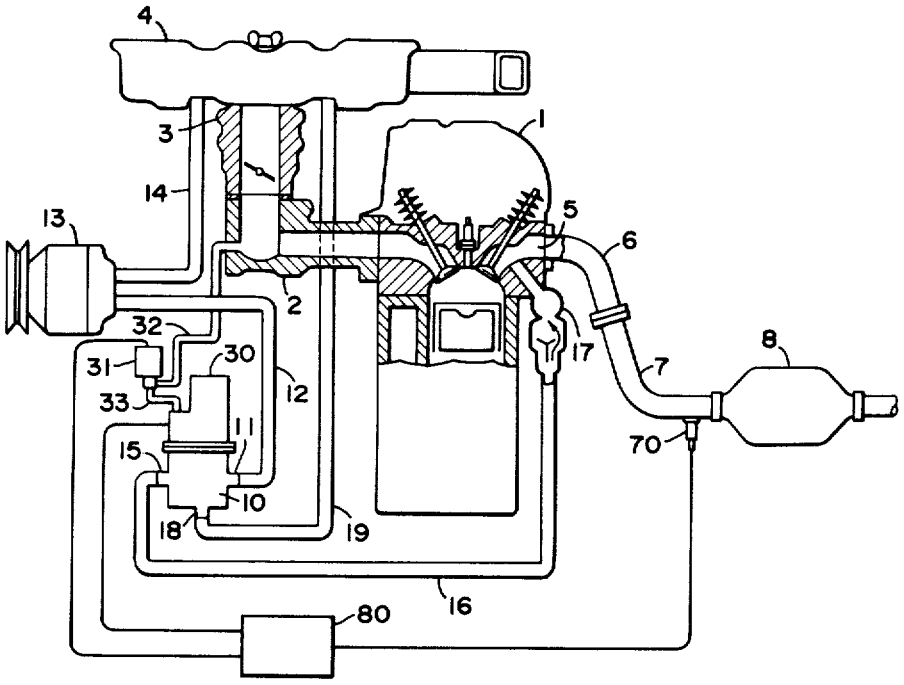
FIG. 2 is a diagram, partly sectional, of the systematic piping indicating the secondary air feed system to which the exhaust gas control actuator according to the present invention is applied.

Referring more particularly to the drawings, FIG. 2 is an explanatory view showing a secondary air feed system in which the exhaust gas control actuator according to the present invention is adopted. An intake manifold 2 of an engine 1 is provided with a carbureter 3, and an air cleaner 4 is installed at a position upstream of the carbureter 3. An exhaust port 5 of the engine 1 is provided with an exhaust manifold 6, and a three-way catalytic converter 8 is disposed at a position downstream of an exhaust pipe 7.

The three-way catalytic converter 8 is adapted to simultaneously purify all of HC, CO and $NO_x$ within a range of air-fuel ratio of about plus or minus 2% centering around the theoretical air-fuel ratio. With the engine 1, to suppress the generation of $NO_x$ in the engine due to the combustion at an air-fuel ratio close to the theoretical air-fuel ratio, an exhaust gas control actuator comprising a flow control valve 10 and a flow control device 30 is disposed in which, an air-fuel mixture at the theoretical air-fuel ratio or at an air-fuel ratio slightly richer than the theoretical air-fuel ratio is burned and secondary air is fed to the exhaust piping so that the air-fuel ratio of exhaust gas at the three-way catalyst converter becomes equal to one in the case of burning at the theoretical air-fuel ratio.

A flow control valve 10 is provided with a flow-in port 11, connected to the flow-in port 11 is an air pump 13 via an air flow-in pipe 12, and the air pump 13 is connected to an air cleaner 4 via an air introducing pipe 14. The air pump 13 is connected to an output shaft of the engine 1 to be driven and is adapted to deliver the amount of air to the flow-in port 11 in proportion to RPM of the engine. Additionally, the flow control valve 10 is provided with a flow-out port 15, the flow-out port 15 is connected to a feed port 17 via an air flow-out pipe 16, the feed port 17 is connected to an exhaust port 5 of the engine 1. Further, the flow control valve 10 is provided with a bypass port 18, the bypass port 18 is connected to the air cleaner 4 via a bypass conduit 19. The flow control device 30 controls the flow control valve 10 and is adapted to be actuated by a solenoid valve 31 and a lock coil 51 which will be described hereinafter. One of the ports of the solenoid valve 31 is connected to the intake manifold 2 via a vacuum conduit 32, and the other port is connected to an actuating chamber 38, which will be described hereinafter, via a vacuum conduit 33. Additionally, an $O_2$ sensor 70 is fixed at the side of an inlet of the three-way catalytic converter 8 of an exhaust pipe 7, an output signal from the $O_2$ sensor 70 is transmitted to the electronic control circuit 80, and an output from the electronic control circuit 80 is adapted to actuate the selenoid valve 31 and the lock coil 51.

Namely, as will be detailedly described hereinafter, is this secondary air feed system, secondary air is fed from the air pump 13 to the exhaust pipe 7 via the flow control valve 10, an output from the $O_2$ sensor 70 provided immediately before the three-way catalytic converter 8 is transmitted to the electronic control circuit which feeds back the feed of secondary air to the flow control device 30, to thereby maintain the air-fuel ratio of the exhaust gas flowing into the three-way catalytic converter 8 in a narrow range centering around the theoretical air-fuel ratio.

Figure 3:
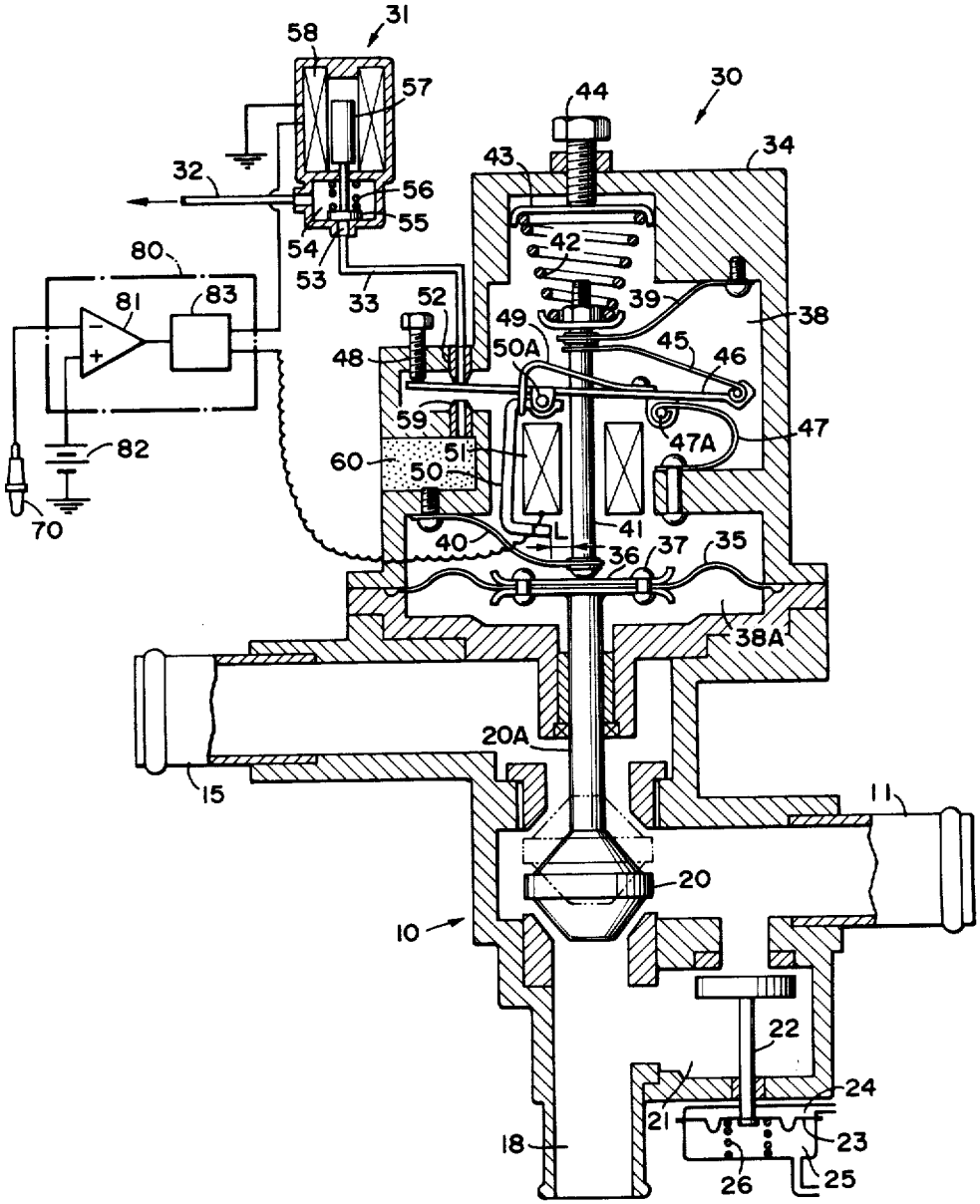
FIG. 3 is a view, partly sectional, showing one embodiment of the exhaust gas control actuator according to the present invention.

FIG. 3 is an explanatory view detailedly showing the exhaust gas control actuator relating to the present embodiment. The valve body 20 is movably provided at the intersection of the flow-in port 11, the flow-out port 15 and a bypass port 18 of the flow control valve 10. Additionally, the flow-in port 11 can be directly connected to the bypass port 18 through a communicating passageway 21 which is provided with a vacuum control valve 22. The vacuum is provided with a diaphragm 23 which functions as a partition wall between an atmosphere chamber 24 and a vacuum chamber 25 connected to the intake manifold 2. The vacuum chamber 25 is installed with a compression spring 26. Namely, the vacuum control valve 22 is closed with the decrease of the vacuum of the manifold, whereby the amount of air delivered from the flow-in port 11 to the flow-out port 15 is increased, thereby increasing the amount of secondary air fed to the exhaust port 5. On the other hand, the flow control device 30 is provided at the lower portion of the interior of a housing 34 thereof with a diaphragm 35. The diaphragm 35 is clamped between a support rod portion 20A of the aforesaid valve body 20 provided at the lower surface thereof and a plate 36 provided at the upper surface thereof. The support rod portion 20A and the plate 36 are solidly secured to the diaphragm 35 by rivets 37. The housing 34 is divided by the diaphragm 35 into an upper actuating chamber 38 and an atmosphere chamber 38A constantly communicated with atmosphere. The actuating chamber 38 is provided in the interior thereof with thin plate-like stays 39, 40 solidly secured to the right and left walls of the housing 34 as shown in the drawing. Opposite ends of a control core 41 are fixed on the tips of the above stays 39 and 40. As the control core 41 ascends from the lower end portion to the upper end portion shown in FIG. 3, the opposite end portion of the control core 41 move on the radius of gyration defined by the lengths of the arms of the stays 39 and 40. Thus, the control core 41 ascends or descends, gradually varying the inclination within a given angular range (Refer to FIG. 6). A compression spring 42 is confined between the upper end portion of the control core 41 and a spring receiving tray 43 which is positionally adjustably supported by an adjusting screw 44 projectingly provided at the upper end face of the interior of the housing 34. The lower end portion of the control core 41 is integrally operationally associated with the rod support portion 20A of the valve body 20 by the biasing force of the compression spring 42, pressure in the actuating chamber 38 and pressure in the atmosphere chamber 38A. In the static condition, the control core 41 urges the valve body 20 to the side of the bypass port 18 by the biasing force of the compression spring 42, and communicates the flow-in port 11 with the flow-out port 15 in fully opened condition.

Furthermore, one end of a support 45 is fixed to a portion adjacent to the upper end portion of the control core 41, and connected through a pin to the other end of the support 45 is one end of a flapper 46. One end of a leaf spring 47 is connected through a pin to a portion adjacent to the above pin-connection and at the intermediate portion of the flapper 46, and the other end of the leaf spring 47 is fixed on the housing 34. The other end of the flapper 46 is extended to be able to abut against the lower end of a fulcrum screw 48 threadably coupled to the housing 34, a portion of the flapper 46 adjacent to the fulcrum screw 48 has the upper surface thereof opposed to a negative pressure introducing port 52 and the under surface thereof opposed to an atmosphere introducing port 59, and the clearances between the flapper 46 and the negative pressure introducing port 52 and between the flapper 46 and the atmosphere introducing port 59 are adjustable by the vertical movement of the fulcrum screw 48. Thus, the nozzle flapper mechanism is arranged as described above. Furthermore, one end of a fixed spring 49 is solidly secured to the upper surface of the flapper 46 and adjacent to the position where the above leaf spring 47 is installed, the other end of the fixed spring 49 is engaged with an armature 50 supported through a pivot 50A on the surface opposite to the position of abutment against the aforesaid fulcrum spring 48 and at the intermediate portion of the flapper 46. The armature 50 is extended to be able to be attracted to the side surface of a lock coil 51 disposed around the intermediate portion of the control core 41, and the forward end portion of the armature 50 is bent at a portion downwardly of the lock coil 51 so as to maintain a clearance L with the side surface of the control core 41 at the time of not being attracted.

The vacuum introducing port 52 is communicated with the vacuum port 53. The solenoid valve 31 is provided in the valve chamber 54 thereof with a valve body 55 capable of opening and closing the vacuum port 53. The valve body 55 is biased by the compression spring 56 to the direction to close the vacuum port 53, and adapted to open the vacuum port 53 with the movable plunger 57 being actuated by a solenoid 58. In addition, the valve chamber 54 is constantly communicated through the aforesaid vacuum conduit 32 with the intake manifold 2 to be vacuum.

A comparator 81 is provided with an electronic control circuit 80 for actuating a solenoid 58 disposed in the solenoid valve 31 and the lock coil 51 disposed in the actuating chamber 38 in the flow control device 30. Connected to one input end of the comparator 81 is the aforesaid $O_2$ sensor 70, and to the input end is a reference voltage source 82. The $O_2$ sensor 70 supplies an output voltage of about 0.9 V when the air-fuel ratio of the exhaust gas in the exhaust piping is on the rich side, and supplies an output voltage of about 0.1 V when the air-fuel ratio in the exhaust piping is on the lean side. The output of the comparator 81 assumes high level conditions when the output voltage of the $O_2$ sensor 70 is about 0.1 V, and assumes low level conditions when the output voltage of the $O_2$ sensor is about 0.9 V. The output of the comparator 81 is transmitted to a timer circuit 83 having amplifying action, and the output from the timer circuit 83 is adapted to excite the solenoid 58 or the lock coil 51 as will hereunder be described.

Figure 4:
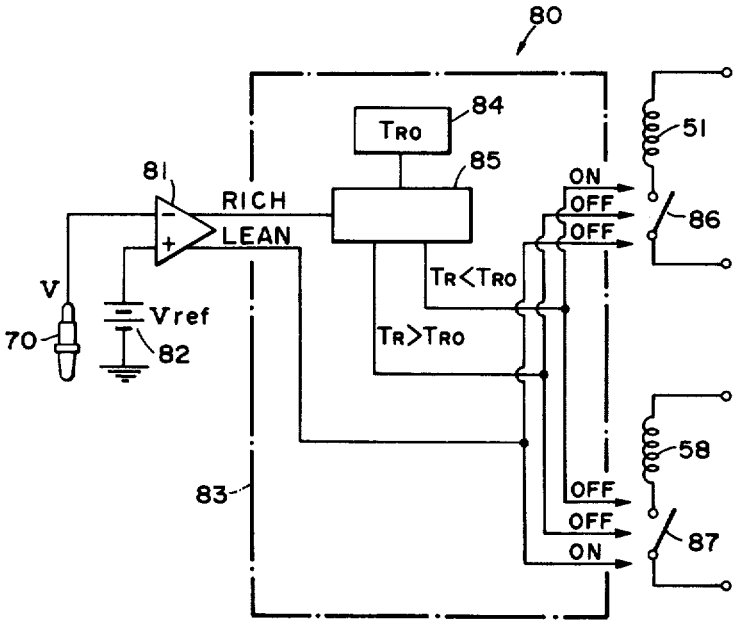
FIG. 4 is a wiring diagram showing the electronic control circuit in the above embodiment.

As shown in FIG. 4, the timer circuit 83 has a time comparator 85 with a reference time generator 84, and is adapted to make and break a first switch 86 for turning the lock coil 51 "ON" or "OFF" in accordance with the output value of the comparator 81 and a second switch 87 for turning the solenoid 58 "ON" or "OFF." Namely, as shown in the table, in the case the air-fuel ratio in the exhaust piping is on the lean side, the output voltage from the $O_2$ sensor is less than the reference voltage $V_{ref}$ from the reference voltage source 82 and the comparator 81 supplies an output of a lean signal, the first switch 86 is turned "OFF" and the second switch 87 is turned "ON" to energize the solenoid 58. Additionally, when the air-fuel ratio of the exhaust gas is on the rich side and the comparator 81 supplies an output of a rich signal, the following process is carried out by the time comparator 85. When the rich signal sustained time $T_R$ is shorter than the reference time $T_{RO}$ transmitted by the reference time generator 84, it is arranged that the first switch 86 is turned "ON," the lock coil 51 is excited and the second switch 87 is turned "OFF." When the rich signal sustained time $T_R$ is longer than the reference time $T_{RO}$, it is arranged such that both the first and the second switches 86 and 87 are turned "OFF."

| | | Lock coil 51 | Solenoid 58 |
|---|---|---|---|
| Lean signal | | OFF | ON |
| | Short time | ON | OFF |
| Rich signal | | | |
| | Long time | OFF | OFF |

Figure 5:
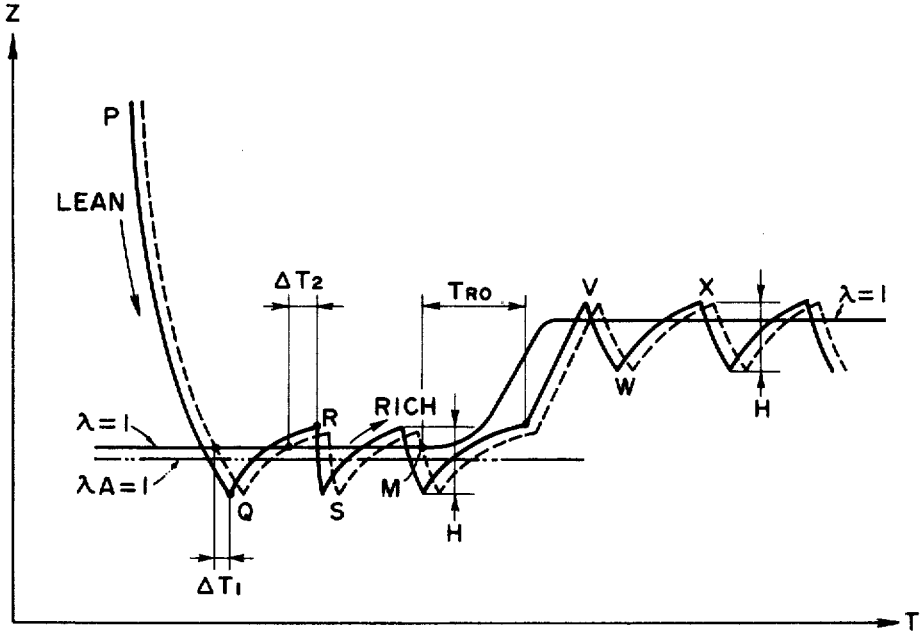
FIG. 5 is a diagram of a wave form showing the controlling conditions for the feed of secondary air.

Description will hereunder be given of the operating conditions of the flow control valve 10 and the flow control device 30 in accordance with the output signals from the $O_2$ sensor 70 with reference to FIG. 5. FIG. 5 is a wave form view showing the control characteristics of the exhaust gas control actuator of the present embodiment. Plotted as abscissa is the time T, and as ordinate the vertical positions of the valve body 20 of the flow control valve 10, i.e. the feed rate of secondary air introduced to the exhaust piping via the flow-out port 15. The wave form indicated by solid lines in FIG. 5 shows the air-fuel ratio of the exhaust gas in the exhaust pipe 7 to which secondary air is fed, while the wave form indicated by dotted lines shows the air-fuel ratio detected by the $O_2$ sensor. The air-fuel ratio detected by the $O_2$ sensor is drawn being laterally offset by the value of the transfer lag relative to the air-fuel ratio of the exhaust gas indicated by the solid lines because there is a transfer lag generated by the operating conditions during the period of time the exhaust gas moves from the secondary air feeding position to the detecting position of the $O_2$ sensor.

Figure 1:
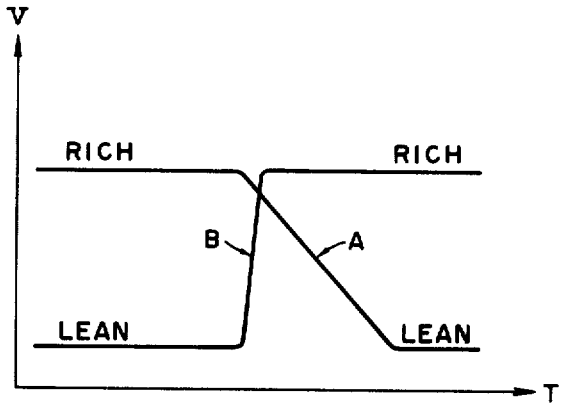
FIG. 1 is a diagram showing the time-output characteristics of the oxygen concentration detector.

Furthermore, in FIG. 5, the portions of lines descending obliquely, rightwardly and downwardly show the cases where the air-fuel ratio of the exhaust gas is on the lean side and the $O_2$ sensor supplies an output of a lean signal, while the portions of the lines ascending rightwards and upwards show the cases where the air-fuel ratio of the exhaust gas is on the rich side and the $O_2$ sensor supplies an output of a rich signal. Namely, the air-fuel ratio of the exhaust gas is apparently changed to the lean side more than the air-fuel ratio of the carbureter by supplying of secondary air, the air-fuel ratio of the exhaust gas passing through the exhaust pipe 7 becomes leanest when the feed of secondary air is at its maximum, and the air-fuel ratio of the exhaust gas becomes equal to the air-fuel ratio of the carbureter when the feed of secondary air is at its minimum, i.e. zero (0). Additionally, a bent line of $\lambda=1$ in the drawing show the feed of secondary air required for making the air-fuel ratio of the exhaust gas passing through the exhaust pipe 7 to be the theoretical air-fuel ratio, and the change-over between the lean signal and the rich signal from the $O_2$ sensor is performed when the $O_2$ sensor detects the passage of the feed of secondary air through the above line with some time lag after the passage of the feed of secondary air occurred. The time lag $\Delta T_1$ indicates the lag time in response from the change of the actual exhaust gas from the lean side to the rich side to the change-over of the output of the $O_2$ sensor from the lean signal to the rich signal at the position where the $O_2$ sensor is installed. The time lag $\Delta T_2$ indicates the lag time in response from the change of the actual exhaust gas from the rich side to the lean side to the change-over of the output of the $O_2$ sensor from the rich signal to the lean signal at the position where the $O_2$ sensor is installed. These time lags $\Delta T_1$ and $\Delta T_2$ are based on the lag time in operation of the electric circuit up to the operation of the valve body of the flow control valve and the flow control device 30, and on the time lag characteristics of the $O_2$ sensor described above with reference to FIG. 1. The lag time $\Delta T_2$ for the change-over of the output of the $O_2$ sensor from the rich signal to the lean signal is longer than the other. Additionally, a line of $\lambda_A=1$ indicates the average flow rate of secondary air actually fed to the exhaust piping, and is offset from the value required for obtaining $\lambda=1$ to the rich side slightly. The reason will be described hereinafter.

Now, the air-fuel ratio of the carbureter 3 is rich at the first stage of complete explosion of the engine 1 in the normal temperature starting as indicated at P in FIG. 5. However, with the maximal feed of secondary air being fed to the exhaust pipe 7, the $O_2$ sensor generates a lean signal. The solenoid 58 of the solenoid valve 31 is excited by the aforesaid signal process by the electronic control circuit 80 in accordance with the lean signal from the $O_2$ sensor, and the valve chamber 54 in the vacuum condition is communicated with the negative pressure introducing port 52 via the vacuum conduit 33 by the ascent of the valve body 55. By this, the vacuum in the actuating chamber 38 increases, the diaphragm 35 is attracted upwards against the biasing force of the compression spring 42, and the valve body 20 of the flow control valve 10 integral with the diaphragm 35 ascends to gradually decreases the area of the communicating flow passageway between the flow-in port 11 and the flow-out port 15, thereby decreasing the feed of secondary air being fed to the exhaust piping. When the air-fuel ratio of the exhaust gas at the position where secondary air is fed, i.e. the exhaust port 5 reaches the theoretical air-fuel ratio $\lambda=1$ due to the decrease of the feed of secondary air, the output from the $O_2$ sensor is changed from the lean signal to the rich signal at a certain lag time. Here, the change-over of the output of the $O_2$ sensor from the lean signal to the rich signal is accompanied by the transfer lag and the lag time $\Delta T_1$ as described above, the air-fuel ratio of the exhaust gas overshoots the theoretical air-fuel ratio to be shifted on the rich side to a certain extent. Additionally, as the valve body 20 ascends, the flapper 46 ascends through the control core 41 to lessen the clearance between the vacuum introducing port 52 and itself so as to gradually increase the channel resistance of the vacuum introducing port 52, so that the flapper action for decreasing the rate of change of the vacuum in the actuating chamber 38 can be carried out, whereby the moving speed of the valve body 20 with respect to time as shown in FIG. 5 is gradually decreased, thereby negative feedback controlling the feed of secondary air.

Figure 6:
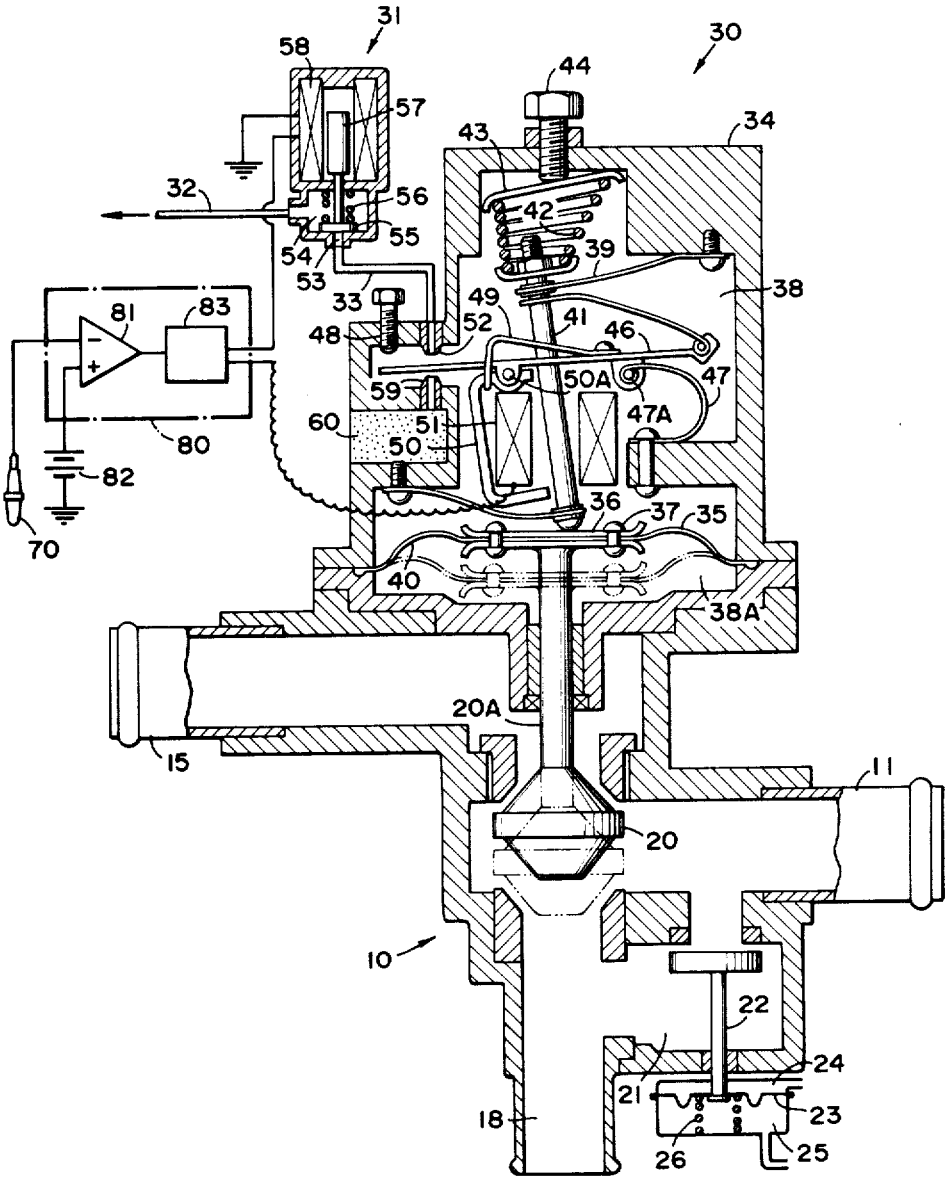
FIG. 6 is a view, partly sectional, showing the action of the exhaust gas control actuator shown in FIG. 3.

FIG. 6 is an explanatory view showing the operating condition in the case that the valve body 20 of the flow control valve 10 closes the flow-out port 15, and the control core 41 of the flow control device 30 is located at the upper end position. If the output of the $O_2$ sensor is changed over to the rich signal from this condition as described above, then the solenoid valve 31 is broken by the electronic control circuit 80 to close the vacuum port 53 and excite the lock coil 51 in the actuating chamber 38 to rotate the armature 50 about the pivot 50A, and the armature 50 is attracted to the control core 41 inclined in the axis thereof by the ascent as aforesaid, whereby the forward end portion of the armature 50 is rotated by a distance L to abut against the side face of the control core 41. The flapper 46 receives a counterclockwise bending moment about the fulcrum 47A by the actuation of the armature 50, and is removed from the vacuum introducing port 52 to approach toward the atmosphere introducing port 59. The atmosphere introducing port 59 constantly communicated with atmosphere through the filter 60, performing the flapper action with the flapper 46, decreases the vacuum in the actuating chamber 38, and the diaphragm 35 is moved downwards by the biasing force of the compression spring 42 to move the valve body 20 downwards, so that the feed of secondary air fed to the exhaust piping can be gradually increased in accordance with the locus QR indicated in FIG. 5. Here, the flapper 46 gradually decreases the clearance with the atmosphere introducing port 59 as the valve body 20 descends, whereby the locus QR is changed such that the rate of change in the movement of the valve body 20 gradually decreases, so that the change in the air-fuel ratio of the exhaust gas is controlled by negative feedback. The solenoid valve 31 is energized again upon the lapse of the lag time $\Delta T_2$ due to the delay in the aforesaid change-over action of the $O_2$ sensor from the rich signal to the lean signal and so forth after the air fuel ratio of the exhaust gas became the theoretical air-fuel ratio at the position where the $O_2$ sensor is installed, the excitation of the lock coil 51 is interrupted, the feed of secondary air fed to the exhaust pipe 7 begins to decrease again, and the air-fuel ratio of the exhaust gas follows the wave form of RS shown in FIG. 5 under the negative feedback control similarly to the above.

Thus, in the normal operating conditions where the fluctuation of the air-fuel ratio of the carburetor 3 is small, the air-fuel ratio of the exhaust gas is controlled by negative feedback in accordance with the sarrate wave form as designated at Q, R, S, . . . within a small range of about $\pm 0.5$ as centered about $\lambda_A$. In addition, the aforesaid wave form PQ makes it possible that the feed of secondary air can be corrected in a wide range in accordance with the requirement in output of the engine, the maximal correcting range corresponds to the maximal value of the movement of the diaphragm 35, which makes possible the control of about 6 as calculated in the terms of the air-fuel ratio of the exhaust gas.

Here, the control wave form Q, R, S, . . . , with the purification performance of and durability of the catalyst being taken into account, can form a triangular wave form, a serrate wave form or a desirable integral wave form which meets the requirements of the control characteristics by combining the diameters of the vacuum port 53 and the atmosphere introducing port 59 and the clearance therebetween, the ratio of arms of the flapper 46 and the like, the frequency response of the wave form is preferably set between about 0.6 and 3 Hz. The serrate wave forms Q, R, S, . . . in the present embodiment are given such forms that can solve the problems derived from the output characteristics of the $O_2$ sensor as described above.

Namely, to control the overshoot of the air-fuel ratio of the exhaust gas from the theoretical air-fuel ratio due to the delay at the time of the change-over of the signal from the $O_2$ sensor, such control wave forms are obtained that the rate of change in the feed of secondary air with respect to time is large at the beginning stage of the change-over of the signal from the $O_2$ sensor and decreases with time by the utilization of the flapper mechanism. Additionally, the rate of change in the feed at the time when the feed of secondary air increases is set at a valve less than the rate of change in the feed at the time when the feed of secondary air decreases, so that the overshoot of the air-fuel ratio of the exhaust gas generated by the lag time $\Delta T_2$ in detection at the time of the change-over from the rich signal to the lean signal of the $O_2$ sensor is not excessively larger than the overshoot generated by the lag time $\Delta T_1$ in detection at the time of the change-over from the lean signal to the rich signal. Moreover, as for the lean shift characteristics of the output of the $O_2$ sensor, the feed rate changing characteristics when the feed of secondary air increases and decreases is determined such that the rate of change of the former is set at a value less than that of the latter, so that the average air-fuel ratio $\lambda_A$ corresponding to the average value of the feed of secondary air can be shifted to the rich side of the air-fuel ratio of the exhaust gas for compensation as shown in FIG. 5.

The feed rate changing characteristics of secondary air as described above can be achieved in the following manner. Namely, when the $O_2$ sensor sends out a lean signal and the control core 41 is ascending to decrease the feed of secondary air, the lock coil 51 is demagnetized and the armature 50 is removed from the control core 41. Consequently, the flapper 46 is abutted at the forward end thereof against the fulcrum screw 48 by the leaf spring 47 (Refer to FIG. 3). Accordingly, since the flapper 46 rotates on the fulcrum screw 48 by the ascent of the control core 41 in this condition, the value of ascent of the flapper 46 at the portion opposed to the vacuum introducing port 52 is determined to be less than the value of ascent of the control core 41, to be 1/N for example. This value N is determined by the ratio between the length of the flapper 46 and the length from the fulcrum screw 48 to the negative pressure introducing port 46. On the other hand, when the $O_2$ sensor sends out a rich signal and the control core 41 begins to descend to increase the feed of secondary air from this condition, the lock coil 51 is excited, the armature 50 is attracted to the control core 41, at which instant, the forward end of the flapper 46 is released from the fulcrum screw 48, and thereafter, the flapper 46, armature 50 and control core 41 descend integrally.

Consequently, in this case, the value of descent of the portion of the flapper 46 opposed to the atmosphere introducing port 59 comes to be equal to that of the control core, and the maximal descent value of the control core 41 (the value descented by the control core 41 until the flapper 46 reaches the atmosphere introducing port 59) is fixed at a small value of about 1 as expressed in term of the change in the air-fuel ratio, despite the value ascended by the control core 41 up to the change-over time of the signal from the $O_2$ sensor, from the reasons which will be described hereinafter. Namely, the value of the movable distance of the control core 41 and the valve body 20 integrally movable therewith is determined by the values of the movable distances for which the portions of the flapper 46 opposed to the negative pressure introducing port 52 and the atmosphere introducing port 59 move until being abutted against the negative pressure introducing port and the atmosphere introducing port. Here, the control core 41, while ascending, is adapted to have a value of movement N times larger than that of the portion of the flapper 46 opposed to the negative pressure introducing port. Hence, as for the rate of change in the feed of secondary air, smaller characteristics is obtainable when the feed of secondary air increases as described above. Additionally, since the control core 41 is arranged to gradually inclined while ascending as described above, in the case the control core 41 ascends and the flapper 46 approaches the negative pressure introducing port, if the lock coil 51 is excited, then the counterclockwise moment shown in the drawing which acts on the flapper 46 becomes large, to thereby turn the flapper 46 on a large scale. Additionally, in the case the value of ascent of the control core 41 is small and the flapper 46 becomes distant from the negative pressure introducing port 52, if the lock coil 51 is excited, the counterclockwise moment shown in the drawing which acts on the flapper 46 becomes small, to thereby turn the flapper on a small scale. Accordingly, when the lock coil is excited, the flapper 46 constantly maintains a given clearance with the vacuum introducing port 52. In other words, the flapper 46 is adapted to maintain a given clearance with the atmosphere introducing port 59 as well. Hence, thereafter, the value of descent which the control core 41 can make is fixed at a small value as described above.

Description will hereunder be given of the operating condition in the case that, during the acceleration or high output of the vehicle, the air-fuel ratio of the carburetor 3 is sharply shifted to the rich side immediately after the rich signal is sent out from the $O_2$ sensor 70, the duration $T_R$ of the rich signal is larger than the reference time $T_{RO}$, to thereby prevent the lean signal from being sent out. Namely, when the lean signal is not generated within 0.2 to 0.3 sec after the signal M (lean→rich) is sent out from the $O_2$ sensor 70 as shown in FIG. 5, the excitation of the lock coil 51 is interrupted through the agency of the timer circuit 83 described with reference to FIG. 4. The interruption of the excitation of the lock coil 51 releases the armature 50 from the control core 41, the flapper 46 is turned by the leaf spring 47 to increase the clearance with the atmosphere introducing port 59, atmosphere is taken in through the atmosphere introducing port 59, the vacuum in the actuating chamber 38 sharply approaches atmosphere, the diaphragm 35 moves downwards by the biasing force of the compression spring 42, the valve body 20 of the flow control valve 10 is moved towards the bypass port 18 to thereby sharply open the flowout port 15, and the feed of secondary air fed to the exhaust piping is sharply increased, to thereby control the air-fuel ratio with the theoretical air-fuel ratio of $\lambda=1$ in a short period of time. It is arranged that, after the air-fuel ratio of the exhaust gas has reached the theoretical air-fuel ratio, the $O_2$ sensor sends out a lean signal and a rich signal alternately to control the feed of secondary air in accordance with the control wave form designated at V, W, X, . . . as shown in FIG. 5. Namely, the air-fuel ratio of the exhaust gas is rapidly set at the theoretical air-fuel ratio by secondary air fed in quick response to the change of the air-fuel ratio of the carburetor 3 under the timer control action as described above.

Description will hereunder be given of the load control characteristics for controlling the feed of secondary air in accordance with the change in the amount of intake air effected by the engine. The feed of secondary air required for the exhaust piping must be controlled in accordance with the change in RPM of the engine and the vacuum of intake air. In this embodiment, the air pump 13 which is the source of supply of secondary air is interlocked with the driving shaft of the engine and driven at RPM commensurate to RPM of the engine, so that the control of RPM of the feed of secondary air is automatically carried out. On the other hand, the load control for controlling the feed of secondary air in accordance with the change in the amount of intake air is effected by the action of the vacuum control valve 22 provided in the communicating passageway 21 of the flow control valve 10. Namely, a large amount of secondary air delivered from the air pump 13 is introduced from the flow-in port 11 to the bypass port 18 by the action of the vacuum control valve 22 which communicates the flow-in port with the bypass port 18 through the comminicating passageway 21 with the increase of the vacuum of intake air, whereby the feed of secondary air fed to the exhaust piping from the flow-out port 15 is decreased, thereby enabling to control the feed of secondary air in proportion to the increase or decrease of the vacuum of intake air.

Figure 7:
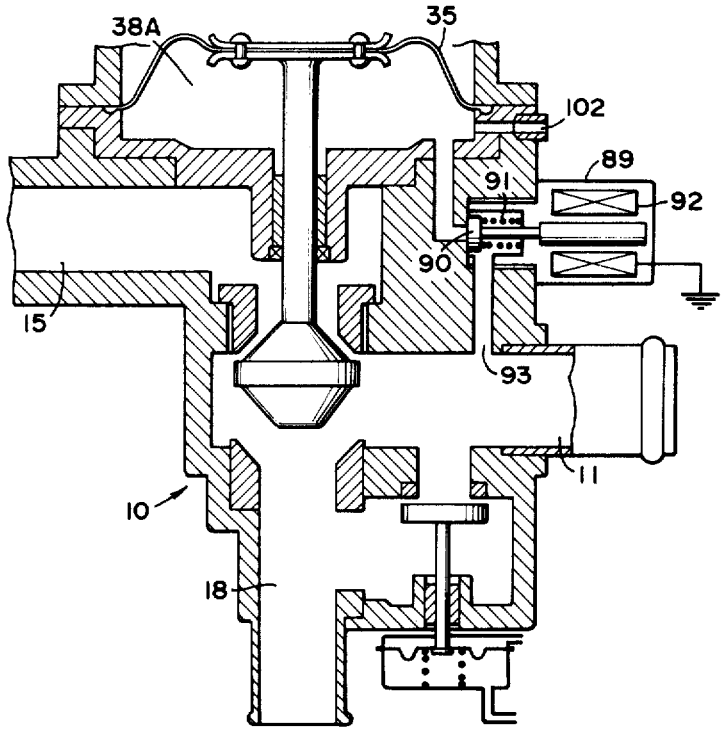
FIG. 7 is a view, with essential portions being sectioned, showing the second embodiment of the exhaust gas control actuator according to the present invention.
Figure 8:
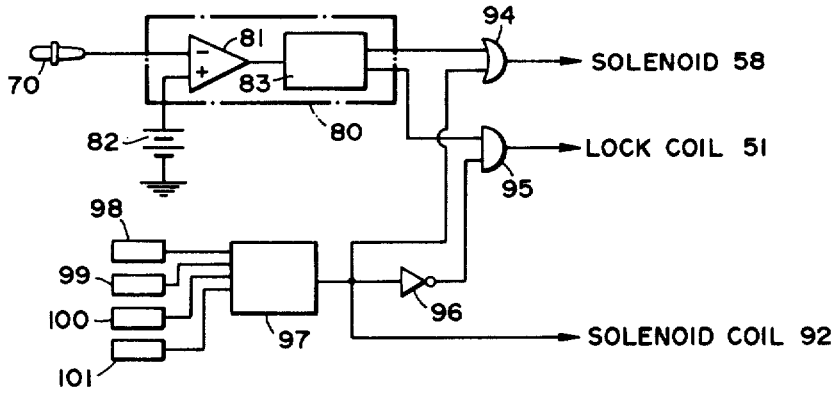
FIG. 8 is a wiring diagram showing the electric circuit in the second embodiment.

Description will hereunder be given of the second embodiment of the present invention with reference to FIGS. 7 and 8. The second embodiment is the embodiment wherein a mechanism of cutting or reducing secondary air for protecting the catalyst from overheating is added to the first embodiment shown in FIGS. 3 and 6. The arrangement and action other than that described above are identical with that of the first embodiment, and hence, description will be given of only the mechanism of cutting secondary air. Referring to FIG. 7, designated at 89 is a solenoid valve for cutting secondary air comprising a valve body 90, a spring 91 and a solenoid coil 92. The valve body normally closes a communicating passageway 93 provided between a flow-in port 11 of a flow control valve 10 and an atmosphere chamber 38A of a flow control device 30 by the spring 91. Additionally, the atmosphere chamber 38A of the flow control device 30 is provided at an atmosphere introducing port with a throttle 102. Since the solenoid valve for cutting secondary air is arranged as above, when the solenoid coil 92 is energized, the valve body 90 is attracted against the spring 91 to open the communicating passageway 93, so that the pressurized secondary air from an air pump 13 is introduced into the atmosphere chamber 38A from a passageway 32. On the other hand, FIG. 8 shows an electric circuit in the second embodiment, the arrangement indicated by reference numerals 70, 80, 81, 82 and 83 is identical with that shown in the first embodiment, and one output from an electronic control circuit 80 is sent to a solenoid 58 via an OR circuit 94, or another output to a lock coil 51 via an AND circuit 95. Additionally, designated at 98, 99, 100 and 101 are a cooling water temperature sensor, and exhaust gas temperature sensor, a high load operation sensor and a deceleration operation sensor, which detect the operating conditions for cutting the feed of secondary air, i.e. the times when cooling water temperature is low, the exhaust gas is overheated, the engine is operated at high load, and deceleration operation is performed, respectively. Designated at 97 is a secondary air cut control circuit, receives outputs of detections from the sensors 98, 99, 100 and 101, and supplies an output signal (1) at the operating condition where secondary air should be cut. Consequently, when the condition for cutting secondary air is not ready, 0 is supplied to one of the input ends of the OR circuit 94, 1 to one of the input ends of the AND circuit via an inverter 96, and 0 to the solenoid coil 92, respectively. Consequently, in this condition, outputs from the electronic control circuit 80 are supplied to the solenoid 58 and the lock coil 51 as they are. Additionally, since the solenoid valve 89 for cutting secondary air is closed, the flow control valve 10 and the flow control device 30 act in the same manner as in the first embodiment above. On the other hand, when the condition for cutting secondary air is ready, 1 is supplied to one of the input ends of the OR circuit 94, 0 to one of the input ends of the AND circuit via the inverter 96, and 1 to the solenoid coil 92, respectively. Consequently, in this case, the solenoid 58 is constantly "ON" despite of the output from the electronic control circuit 80, the lock coil 51 is constantly "OFF" despite of the output from the electronic control circuit 80, and the solenoid valve for cutting secondary air is constantly open. Accordingly, negative pressure is constantly introduced into the actuating chamber 38 of the flow control device 30, and pressurized secondary air is introduced into the atmosphere chamber 38A, so that the diaphragm 35 is urged upwards in the drawing. Since the lock coil 51 is "OFF" in this case, a rod 20A is freely movable and the diaphragm 35 moves upwards. Consequently, a valve body 20 also moves upwards to close a flow-out port 15, whereby the whole of the feed of secondary air is delivered to the bypass port 18, thereby cutting secondary air.

It should be apparent to one skilled in the art that the above described embodiments are merely illustrative of but a few of the many possible specific embodiments of the present invention. Numerous and varied other arrangements can be readily devised by those skilled in the art without departing from the spirit and scope of the invention.

What is claimed is:

1. An exhaust gas control actuator wherein the feed of secondary air fed to an exhaust piping is controlled by a signal-emitting oxygen concentration detector disposed in the stream of exhaust gas of an internal combustion engine whereby an air-fuel ratio of the exhaust gas entering a catalyst disposed down-stream of the exhaust piping is maintained within a given range, said actuator comprising:

a flow control valve having a housing provided with a valve chamber, a flow-in port communicating said chamber with an air pump, a flow-out port communicating said chamber with an exhaust piping, a bypass port communicating said chamber with an air cleaner, and a movable valve body in said chamber controlling flow out of said flow-out port and said bypass port;

a flow control device for controlling said flow control valve comprising a housing partitioned by a diaphragm connected to said valve body into an actuating chamber and an atmospheric chamber, said actuating chamber having a vacuum introducing port communicating through a conduit with an intake manifold and an atmosphere introducing port constantly communicating with the atmosphere;

a solenoid valve in said conduit having ON-OFF positions;

an electronic circuit for controlling said solenoid valve in accordance with the signal from the detector;

and a nozzle flapper mechanism in said actuating chamber for varying resistance to flow through said vacuum introducing port and said atmosphere introducing port in accordance with the position of said valve body in such a manner that the signal of the oxygen concentration detector is negatively fed back to control the feed of secondary air.

2. An exhaust gas control actuator as set forth in claim 1 characterized in that the nozzle flapper mechanism comprises:

a control core movably connected to the valve body and capable of inclining its axis within the range of movement thereof;

a flapper supported by said control core via a support connected at the proximal end portion of said flapper to the control device housing via a leaf spring;

a fulcrum screw threaded into said housing and engageable by the forward end portion of said flapper for adjusting clearances between the latter and the vacuum introducing port and the atmosphere introducing port;

an armature connected to the intermediate portion of said flapper; and a lock coil controlled by the electronic circuit for moving said armature to lock said flapper to said control core for movement therewith.

3. An exhaust gas control actuator as set forth in claim 2 characterized in that the control core is supported by thin plate stays whose ends are fixed on opposite sides of the housing of the flow control device.

4. An exhaust gas control actuator as set forth in claim 2, characterized in that said flapper rotates on the fulcrum screw along with the movement of the control core when the lock coil is deenergized, and moves integrally with the control core when the lock coil is excited.

5. An exhaust gas control actuator as set forth in claim 1, wherein said electronic control circuit includes a time control circuit for controlling the flow control device in a manner that the feed of secondary air fed to the exhaust piping is made to the maximum or minimum when the output signal of the oxygen concentration detector does not change over for a given period of time.

6. An exhaust gas control actuator as set forth in claim 1, wherein said flow control valve is provided with a negative pressure control valve controlled by the vacuum of the intake manifold.

7. An exhaust gas control actuator as set forth in claim 6, wherein said negative pressure control valve is disposed in a passageway directly connecting said flow-in port to the bypass port.

8. An exhaust gas control actuator as set forth in claim 1, wherein said flow control valve is provided with a secondary air reducing mechanism for communicating the flow-in port with the atmospheric chamber under an operating condition where the feed of the secondary air is to be reduced.

* * * * *